United States Patent [19]

Kosaka et al.

[11] Patent Number: 4,550,328

[45] Date of Patent: Oct. 29, 1985

[54] IMAGE-RECEIVING COLOR-FORMING SHEET FOR TRANSFER ELECTROPHOTOGRAPHY

[75] Inventors: Takao Kosaka, Himeji; Hirokazu Tsukahara, Takasago, both of Japan

[73] Assignee: Mitsubishi Paper Mills, Limited, Tokyo, Japan

[21] Appl. No.: 522,214

[22] Filed: Aug. 11, 1983

[30] Foreign Application Priority Data

Aug. 23, 1982 [JP] Japan ..... 57-146687

[51] Int. Cl.[4] ..... B41M 5/22

[52] U.S. Cl. ..... 346/201; 346/226; 428/913; 428/914; 430/45; 430/126

[58] Field of Search ..... 428/320.4–320.8, 428/411, 488, 537, 913, 914, 411.1, 488.1, 488.4, 500, 523, 537.5; 430/45, 126; 346/200, 201, 226

[56] References Cited

FOREIGN PATENT DOCUMENTS 2651452 5/1977 Fed. Rep. of Germany .

0019840 2/1978 Japan ..... 346/226

0146794 11/1981 Japan ..... 346/226

*Primary Examiner*—Bruce H. Hess

*Attorney, Agent, or Firm*—Cushman, Darby & Cushman

[57] ABSTRACT

Disclosed is an image-receiving color-forming sheet for transfer-type electrophotography which comprises a support, a color forming layer containing an electron accepting material provided thereon and a high resistivity layer, wherein a self-emulsifiable resin mainly composed of acrylate ester and/or methacrylate ester is used as a dielectric substance contained in said high resistivity layer.

7 Claims, No Drawings

IMAGE-RECEIVING COLOR-FORMING SHEET FOR TRANSFER ELECTROPHOTOGRAPHY

This invention relates to an improvement of the image-receiving color-forming sheet especially useful for the one-shot color-image formation method in which a color image is formed through single cycle of exposure and development by applying the technique of electrophotography. More particularly, it relates to the improvement in powder-image transfer efficiency and fastness of the image which is formed on an image receiving sheet by the successive steps of allowing light-transmissible particles containing a colorless heat-sublimable dye, which has a color separating function and is capable of forming color by the reaction with an electron-accepting substance, to adhere electrostatically onto a charged photoconductive photosensitive element, exposing imagewise the resulting photosensitive element, removing mechanically or electrically from the element those particles which have become weakened in or deprived of the electrostatic attractive force, thus leaving behind a powder image, then electrostatically transferring the powder image onto an image-receiving color-forming sheet containing an electron accepting substance, heating the transferred image to form a color by the reaction of the colorless heat-sublimable dye, and removing the waste powder from the image-receiving sheet to leave behind a color image on the sheet.

In the conventional electrophotography which generally employs a photoconductive substance, an electrical latent image is formed by various means on a photosensitive element, then the latent image is developed by use of a colored toner to form a powder image (then, if necessary, the powder image is transferred to a paper sheet or the like), and the powder image is fixed by heating or by means of a solvent vapor or the like. This process, however, presents a pollution problem in handling the colored toner during its manufacture and the development operation. Being a fine powder, the toner is easily subject to dusting and makes dirty the hands and feet of the operators during its manufacture as well as pollutes the environment during the replenishing operation in the development stage. It is also difficult for the conventional process to produce a transparent color image.

To overcome the above difficulties, there is proposed an improved image-forming process [e.g. Japanese Patent Application "Kokai" (Laid-open) No. 149,123/77]. In this image-forming process, the surface of a support containing a photoconductive substance is previously electrostatically coated with an image-forming powder composition comprising a mixture of colorless, transparent, light-transmissible powders which are imparted with a function of color separation into red, green, and blue and which further contain colorless heat-sublimable dyes capable of forming cyan, magenta, and yellow colors. The surface of the electrostatically coated support is then exposed to an optical image to attenuate optically the charge of the support under the light-transmissible powder mixture, whereby a latent image is formed. This latent image is a force pattern resulting from the conversion of light signals from the original into intensity signals of electrostatic attractive force between the support and the powder mixture. Accordingly, a powder image is obtained by applying an external force to remove from the support those powder particles which have been weakened in or deprived of the electrostatic attraction toward the support. A color print is obtained by transferring the powder image to the image-receiving color-forming sheet, then heating to develop the color, and removing the waste powder particles.

The colorless, sublimable dyes used in the above process are colorless or faintly colored, substantially colorless dyes. Examples of colorless dyes capable of forming yellow color are 4-(4-dimethylamino)phenylpyridine, 4-(N-methyl-N-benzylamino)benzylidene-4'-methylaniline, etc. Examples of colorless, sublimable dyes capable of forming magenta color are indolinobenzospiropyranes, typical of which are 7'-diethylamino-1,3,3-trimethylindolinobenzospiropyrane, 7'-diethylamino-1,3,3-trimethyl-4'-(1,3,3-trimethylindolinyl-2-methylene)indolinobenzospiropyrane, and 7'-(N-methyl-N-phenylamino)-1,3,3-trimethyl-4'-(1,3,3-trimethylindolinyl-2-methylene)-indolinobenzospiropyrane. Examples of colorless, sublimable dyes capable of forming cyan color are acylleucophenoxazines such as 3,7-bis(diethylamino)-10-trichloroacetylphenoxazine, 3,7-bis(diethylamino)-10-isobutylylphenoxazine, 3,7-bis(-diethylamino)-10-acetylphenoxazine, 3,7-bis(diethylamino)-10-benzoylphenoxazine, 3,7-bis(diethylamino)-10-dichloroacetylphenoxazine, and 3,7-bis(-diethylamino)-10-monochloroacetylphenoxazine.

Electron accepting substances are suitable for the color formation from the colorless, sublimable dyes. Effective electron acceptors are inorganic substances such as activated clay and zeolite and phenolic substances such as bisphenol A, salicylic acid, p-phenylphenol, or resins formed from these substances. Although not limitative, activated clay is preferred because of its thermal stability.

The color forming layer comprises an electron acceptor and a binder and may contain calcium carbonate, silicon oxide, or the like to assist the color formation or for other reasons. Desirable binders are those which have a high binding strength and which are hardly susceptible to yellowing upon being heated, such as, for example, styrene-butadiene copolymers, acrylic resins, and poly(vinyl acetate)-base resins. After coating, the color-forming layer is preferably calendered to ensure uniformity of the surface resistivity.

This image-receiving color-forming sheet comprising only a color-forming layer containing an electron acceptor should be sufficient in principle for use in color electrophotography. In practice, however, it is generally difficult to obtain a sufficiently high surface resistivity and, as a consequence, the efficiency of electrostatic transfer of the powder image is apt to be insufficient. To avoid such a difficulty, there has been disclosed a structure of image-receiving sheet, in which the color-forming layer is overlaid with a colorless, transparent dielectric or high-resistivity layer which contains polyethylene or silicone resin as dielectric substance and which is highly permeable to the vapor of sublimed dye so that the color formation may not be interfered with [Japanese Patent Application "Kokai" (Laid-open) No. 16,143/81]. The effectiveness of the disclosed technique, however, is limited to a narrow humidity range and the technique is not sufficiently effective especially under an atmosphere of a relative humidity of 70% or above. Moreover, although the color balance of the color image is satisfactory immediately after the formation of color, yet after a long exposure to the natural light or the light from a fluorescent lamp, the color balance among three primary colors of cyan, magenta, and yellow sometimes becomes disrupted owing probably to the photofading, especially the photofading of magenta color. There has existed, therefore, a demand for the improvement of the image-receiving sheet with respect to the above problems.

The present inventor conducted an extensive study to improve said image-receiving sheet and, as a result, has accomplished the present invention which is based on the discovery that it is possible to keep the transfer efficiency of powder image from deterioration and to obtain a sharp and bright color image even under high humidity conditions by overlaying said color-forming layer with a high-resistivity layer which contains as the dielectric substance a self-emulsifiable resin mainly composed of an acrylate ester and/or a methacrylate ester and which is permeable to the molecule of a colorless, sublimable dye. The high-resistivity layer (dielectric layer) is required to be permeable to the molecule of a colorless, sublimable dye, to be transparent so as not to reduce the color density, to have a surface resistivity as high as $10^{12}\ \Omega$ or above, and to resist yellowing when heated to form a color.

As described previously, polyethylene or a silicone resin has been used as the dielectric resin. These resins, however, are unavoidably susceptible to deterioration of the image transfer efficiency owing to the decrease in surface resistivity under high humidity conditions, especially at a relative humidity of 70% or above, though they pose few problems under normal humidity conditions. To the contrary, by the use of a self-emulsifiable resin mainly composed of an acrylate ester and/or a methacrylate ester, it has become possible to retard the decrease in surface resistivity and, hence, in transfer efficiency under high humidity conditions, to improve the color fastness, and to chek the progress of the disruption of color balance caused by a long exposure to sunlight or the like (such disruption occasionally occurs in the conventional image-receiving sheet), probably because of the favorable film-forming properties of the self-emulsifiable resin used according to this invention. This discovery has led to the accomplishment of this invention.

In Japanese Patent Application "Kokai" No. 16,143/81 cited above, a styrene-butadiene copolymer is used as the binder and mention is also made of other binders such as acrylic resins and polyvinyl acetate. Therefore, the self-emulsifiable resins mainly composed of an acrylate ester and/or a methacrylate ester, which are used in this invention, are described below in detail.

The acrylic resins, as a general term, include polymers of acrylic acid, methacrylic acid, acrylonitrile, acrylate esters, and methacrylate esters. To emulsify these polymers, an emulsifier is usually used. According to this invention, an emulsifier-free emulsion of a self-emulsifiable resin such as a resin modified with carboxyl group should be used, because the presence of emulsifiers causes a decrease in surface resistivity and is, therefore, undesirable. The high-resistivity layer should be transparent so as not to reduce the color density. For this reason, the particle size of the emulsion should be as small as possible. In view of the mechanical stability of the emulsion, the polymers of acrylic acid, methacrylic acid, and acrylonitrile are difficult to convert into a fine emulsion. The resin most suitable for the object of this invention is a self-emulsifiable polymer of an acrylate ester and/or a methacrylate ester, because it is easily convertible to a finely dispersed emulsion with good mechanical stability as well as good film-forming ability, the resulting film being transparent. Besides, according to this invention, this resin is used not as a binder but as a dielectric substance. A suitable ester is methyl, ethyl, propyl, or butyl ester. Although these self-emulsifiable resins can be used each alone, they are somewhat inferior to a polyolefin resin in yellowing upon heating. Moreover, being an ester, they sometimes interfere with color formation depending upon the type of dye. To cover these disadvantages, it is recommended to use the self-emulsifiable resin jointly with a polyolefin resin in order to ensure good color balance, high transfer efficiency, and least yellowing upon heating. A suitable ratio of the self-emulsifiable resin to a polyolefin resin is in the range of 10 to 100, preferably 20 to 80, % by weight based on the polyolefin resin. If the self-emulsifiable resin is used in too large an amount, the yellowing upon heating and the color formation may sometimes become inferior. In view of the gas permeability and thermal resistance, it is desirable to add to the emulsion an inorganic powder such as silicon oxide. Desirable binders are those which have a good adherence to the color-forming layer, a high resistivity, and a good transparency. An example of generally useful binders is a styrene-butadiene copolymer. The supports in sheet form include paper, resin-coated paper, plastic film, sheet metal, and so on. Of these materials, paper is generally preferred. In view of the image quality, it is desirable to use a sheet support which has been subjected to conductive treatment.

The invention is illustrated below in detail with reference to Examples. In Examples, all parts are by weight.

EXAMPLE 1

Zinc oxide was sensitized with sensitizing dyes of Rose Bengal, Tartrazine, and Diacid Green GWA. Using the sensitized zinc oxide as photo-conductive substance, a panchromatically photo-sensitive plate sensitive to approximately 350–700 mμ was prepared.

Three solutions of red, green, and blue were prepared according to the following formulas:

| | Parts |
|---|---|
| (1) Red solution: | |
| Water-soluble melamine resin | 100 |
| Curing agent | 10 |
| Rose Bengal | 2 |
| Methyl Orange | 2 |
| Water | 100 |
| (2) Green solution: | |
| Water-soluble melamine resin | 100 |
| Curing agent | 2 |
| Patent View-P-blue (Sumitomo Mikuni Chemical Co.) | 0.5 |
| Levelling Yellow (Sumitomo Chemical Co.) | 2 |
| Kayacion Green (Nippon Kayaku Co.) | 2 |
| Water | 100 |
| (3) Blue solution: | |
| Water-soluble melamine resin | 100 |
| Curing agent | 10 |
| Spirit Blue (Yamamoto Kagaku Gosei Co.) | 3 |
| Rose Bengal | 2 |
| Acid Violet (Kanto Kagaku Co.) | 1 |
| Water | 100 |

The water-soluble melamine resin and the curing agent used in the above formulas were Sumitex M-3

(Sumitomo Chemical Co.) and ERX (Sumitomo Chemical Co.), respectively.

The above three solutions were separately spray-dried to obtain transparent powders of 20–40 μm in particle size and red, green, and blue in color. Using these colored powders, light-transmissible color-forming powders were prepared by the 2-fluid method according to the following formulas:

| | Parts |
|---|---|
| (1) Red-transmissible powder: | |
| Red-colored powder | 100 |
| Colorless sublimable dye to form cyan color [3,7-bis-diethylamino-10-dichloro-acetylphenoxazine] | 5 |
| Polyamide resin | 3 |
| Water | 100 |
| (2) Green-transmissible powder: | |
| Green-colored powder | 100 |
| Colorless sublimable dye to form magenta color [7'-(N—methyl-N—phenylamino)-1,3,3-trimethyl-4'-(1,3,3-trimethylindolinyl-2-methylene)indolinobenzospiro-pyrane] | 3 |
| Polyamide resin | 3 |
| Water | 100 |
| (3) Blue-transmissible powder: | |
| Blue-colored powder | 100 |
| Colorless sublimable dye to form yellow color [4-(N—methyl-N—benzylamino)-benzylidene-4'-methylaniline] | 7 |
| Polyamide resin | 3 |
| Water | 100 |

The polyamide resin used in the above formulas was Arafix 200 (Arakawa Kagaku Co.).

The following coating compositions were prepared for use in making the image-receiving color-forming sheet:

| (1) Coating composition for color-forming layer: | Parts |
|---|---|
| Activated clay (Mizusawa Kagaku Co.) | 100 |
| Calcium carbonate | 30 |
| Colloidal silica | 20 |
| Styrene-butadiene copolymer latex | 15 |
| Water | 100 |

The above ingredients were mixed with stirring to prepare the coating composition for color-forming layer.

| (2) Coating composition for high resistance layer: | |
|---|---|
| Dielectrics: Self-emulsifiable resin emulsion containing isobutyl acrylate as major component (JURIMER SE-365-Kai 75* of Nippon Junyaku Co.) | 17.5 |
| Inorganic fine powder: Colloidal Silica | 8 |
| Binder: Styrene-butadiene copolymer latex | 12.5 |
| Water | 82 |

*According to the analysis of the inventors, this emulsion comprises 31.2 wt % of methyl methacrylate, 6.3 wt % of ethyl methacrylate and 62.5 wt % of isobutyl acrylate.

The above ingredients were mixed with stirring to prepare the coating composition for high-resistance layer.

The color-forming coating composition (1) was coated on a plain paper, 70 g/m$^2$ in basis weight, at a coverage of 8 g/m$^2$ (on dry basis; the same applies hereinafter). After calendering, the color-forming layer was overcoated with the high-resistance coating composition (2) at a coverage of 4.5 g/m$^2$ followed by calendering to produce the image-receiving color forming sheet for transfer electrophotography.

The aforementioned photosensitive plate was charged by a corona device and overspread with a mixture (1:1:1) of the abovementioned light-permissible powders containing colorless sublimable dyes. Being conductive, the powder particles were arranged in monolayer of the close-packed structure. The resulting photosensitive element was exposed through a color pattern and developed by vibration by means of an electromagnetic vibration device. After the whole surface of the developed plate had been exposed, the image pattern was electrostatically transferred to said image-receiving color forming sheet for transfer electrophotography under an atmosphere of 50, 70, or 90% R.H. The transferred image was thermally developed by heating on a hot plate at 220° C. for 5 seconds to produce color image and the waste powder was removed by means of a fur brush, leaving behind a color image.

The test results including the color fastness were as shown in Table 1.

EXAMPLE 2

The procedure of Example 1 was followed, except that a high-resistance coating composition of the following formula was used:

| High-resistance coating composition: | Parts |
|---|---|
| Dielectrics: | |
| Self-emulsifiable resin emulsion containing iso-butyl acrylate as major component (JURIMER SE-365-Kai 75 of Nippon Junyaku Co.) | 5 |
| Low molecular-weight poly-ethylene emulsion (Permalin PN of Sanyo Kasei Co.) | 12.5 |
| Inorganic fine powder: | |
| Colloidal silica | 8 |
| Binder | |
| Styrene-butadiene copolymer latex | 12.5 |
| Water | 82 |

The present Example is characterized by the use of a dielectric mixture of two types of resins.

COMPARATIVE EXAMPLE 1

The procedure of Example 1 was followed, except that the self-emulsifiable resin emulsion containing isobutyl acrylate as major component, which was used in the high-resistance coating composition, was entirely replaced by a low molecular-weight polyethylene emulsion.

COMPARATIVE EXAMPLE 2

The procedure of Example 1 was followed, except that the self-emulsifiable resin emulsion containing isobutyl acrylate as major component, which was used in the high-resistance coating composition, was entirely replaced by an acrylate resin emulsion containing a common-emulsifier (ZE-9 of Goō Kagaku Co.).

TABLE 1

| | Transfer efficiency,* % Humidity | | | Color fastness of image** | Yellowing on heating** |
|---|---|---|---|---|---|
| | 50% RH | 70% RH | 90% RH | | |
| Example 1 | 91 | 83 | 79 | o | Δ |
| Example 2 | 92 | 85 | 78 | o | o |
| Comparative Example 1 | 90 | 69 | 62 | x | o |
| Comparative Example 2 | 90 | 71 | 65 | o | Δ |

Note:
*The efficiency of electrostatic transfer of the powder image was expressed in percent.
**The color fastness of the image when it was left standing in a light room for one month. The mark x represents a loss of color balance.
***The degree of yellowing of the white background after the image was fixed by heating at 220° C. The mark Δ represents a moderate yellowing.

From the results shown in Table 1, it is seen that the present invention brought about an improvement in both the transfer efficiency and the image color fastness under high-humidity conditions (especially under an atmosphere of a relative humidity of 70% or above).

What is claimed is:

1. An image-receiving color-forming sheet for transfer-type electrophotography which forms color from colorless sublimable dyes and which comprises a support, a color forming layer free of dye and containing an electron accepting material provided on the support and a transparent and gas-permeable high-resistivity layer which contains as a dielectric substance a self-emulsifiable resin mainly composed of acrylate ester and/or methacrylate ester.

2. An image-receiving color-forming sheet according to claim 1 wherein the acrylate ester and methacrylate ester are methyl, ethyl, propyl or butyl esters.

3. A process of color image formation comprising using the image-receiving color-forming sheet according to claim 1.

4. An image-receiving color-forming sheet for transfer-type electrophotography which forms color from colorless sublimable dyes and which comprises a support, a color forming layer containing an electron accepting material provided on the support and a transparent and gas-permeable high-resistivity layer which contains in combination as a dielectric substance (1) a self-emulsifiable resin mainly composed of acrylate ester and/or methacrylate ester and (2) a polyolefin resin.

5. An image-receiving color-forming sheet according to claim 4 wherein the acrylate ester and methacrylate ester are methyl, ethyl, propyl, or butyl esters.

6. A process of color image formation with use of the image-receiving color-forming sheet according to claim 4.

7. An image-receiving color-forming sheet according to claim 4 wherein the ratio of the self-emulsifiable resin to the polyolefin resin is in the range of 10 to 100% by weight based on the polyolefin resin.

* * * * *